US006412556B1

(12) United States Patent
Zupanick

(10) Patent No.: US 6,412,556 B1
(45) Date of Patent: Jul. 2, 2002

(54) CAVITY POSITIONING TOOL AND METHOD

(75) Inventor: Joseph A. Zupanick, Pineville, WV (US)

(73) Assignee: CDX Gas, Inc., Dallas, TX (US)

( * ) Notice: Subject to any disclaimer, the term of this patent is extended or adjusted under 35 U.S.C. 154(b) by 0 days.

(21) Appl. No.: 09/632,273

(22) Filed: Aug. 3, 2000

(51) Int. Cl.[7] ..... E21B 47/00

(52) U.S. Cl. ..... 166/255.2; 166/241.3; 166/104; 405/55

(58) Field of Search ..... 166/241.1, 241.3, 166/241.7, 222, 104, 241.2, 241.4, 241.5, 255.2; 417/430; 366/312, 325.2, 308, 249, 254, 66, 195, 343; 175/263, 319; 405/53, 55; 261/92; 416/140, 44

(56) References Cited

U.S. PATENT DOCUMENTS

| | | | |
|---|---|---|---|
| 54,144 A | 4/1866 | Hamar | |
| 130,442 A | 8/1872 | Russell | 166/243 |
| 274,740 A | 3/1883 | Douglass | |

(List continued on next page.)

FOREIGN PATENT DOCUMENTS

| | | | | |
|---|---|---|---|---|
| DE | 197 25 996 A1 | | 1/1998 | E03B/3/10 |
| EP | 0300627 A1 | * | 1/1989 | E21B/17/10 |
| EP | 0 819 834 A1 | | 1/1998 | 43/28 |
| EP | 0 875 661 A1 | | 11/1998 | E21B/43/30 |
| EP | 0 952 300 A1 | | 10/1999 | E21B/7/12 |
| WO | 94 21889 | | 9/1994 | 43/24 |

OTHER PUBLICATIONS

Pending Patent Application, Joseph A. Zupanick, Cavity Well Positioning System and Method, Serial No. 09/696, 338, Oct. 24, 2000.

Joseph A. Zupanick: Declaration of Experimental Use with attached exhibits A–D, pp. 1–3, Nov. 14, 2000.

Howard T. Hartman, et al.; "*SME Mining Engineering Handbook*," Society for Mining, Metallurgy, and Exploration, Inc. pp. 1946–1950, 2nd Edition, vol. 2, 1992.

Pending Patent Application, Joseph A. Zupanick, "*Method for Production of Gas From a Coal Seam*," Serial No. 09/197,687, Filed Nov. 20 1998.

Pending Patent Application, Joseph A. Zupanick, "*Method and System for Accessing Subterranean Deposits From The Surface*," Serial. No. 09/114,029, Filed Nov. 19, 1999.

Pending Patent Application, Joseph A. Zupanick "*Method and System for Accessing Subterranean Deposits From The Surface*," Serial No. 09/789, 956, Filed Feb. 20, 2001.

Pending Patent Application Joseph A. Zupanick, "*Method and System for Accessing Subterranean Deposits From The Surface*," Serial No. 09/788,897, Filed Feb. 20, 2001.

Pending Patent Application, Joseph A. Zupanick, "*Method and System for Accessing Subterranean Deposits From The Surface*," Serial. No. 09/791, 033, Filed Feb. 20, 2001.

Pending Patent Application, Joseph A. Zupanick, *Method and System for Enhanced Access to a Subterrean Zone*, Serial No. 09/769,098, Filed Jan. 24, 2001.

Pending Patent Application, Joseph, A. Zupanick *Method and System for Accessing a Subterrean Zone from a Limited Surface Area*, Serial No. 09/774,996, Filed Jan. 30, 2001.

Pending Patent Application, Joseph A. Zupanick, *Method and System for Accessing a Subterrean Zone from a Limited Surface Area*, Serial No. 09/773,217, Filed Jan. 30, 2001.

Nackerud Product Description, Sep. 27, 2001.

*Primary Examiner*—David Bagnell
*Assistant Examiner*—Daniel P Stephenson
(74) *Attorney, Agent, or Firm*—Baker Botts L.L.P.

(57) ABSTRACT

A cavity positioning tool is provided that includes a head piece adapted to receive a downhole string having a longitudinal axis. A plurality of blunt arms are coupled to the head piece. The blunt arms are operable to be radially extended outward from a first position of substantial alignment with the longitudinal axis to a second extended position.

38 Claims, 5 Drawing Sheets

U.S. PATENT DOCUMENTS 526,708 A 10/1894 Horton
639,036 A 12/1899 Heald
1,189,360 A 7/1916 Gondos
1,230,666 A * 6/1917 Carden
1,285,347 A 11/1918 Otto
1,467,480 A 9/1923 Hogue
1,485,615 A 3/1924 Jones
1,674,392 A 6/1928 Flansburg
1,777,961 A 10/1930 Capeliuschnicoff
2,018,285 A * 10/1935 Schweitzer et al. ..... 166/21
2,033,521 A 3/1936 Horn ..... 166/237
2,069,482 A 2/1937 Seay ..... 255/76
2,150,228 A 3/1939 Lamb ..... 166/10
2,169,718 A 8/1939 Boll et al. ..... 255/24
2,335,085 A 11/1943 Roberts ..... 251/107
2,450,223 A * 9/1948 Barbour ..... 255/76
2,490,350 A 12/1949 Grable ..... 166/1
2,679,903 A 6/1954 McGowen, Jr., et al. ..... 166/1
2,726,063 A 12/1955 Ragland et al. ..... 255/1.8
2,783,018 A 2/1957 Lytle ..... 251/26
2,847,189 A 8/1958 Shook ..... 255/76
2,911,008 A 11/1959 Du Bois ..... 137/625.31
2,980,142 A 4/1961 Turak ..... 137/637.3
3,107,731 A 10/1963 Dinning ..... 166/217
3,236,320 A * 2/1966 Russ ..... 175/263
3,347,595 A 10/1967 Dahms et al. ..... 299/4
3,443,648 A 5/1969 Howard ..... 175/103
3,473,571 A 10/1969 Dugay ..... 137/625.4
3,503,377 A 3/1970 Beatenbough et al. ..... 123/117
3,528,516 A 9/1970 Brown ..... 175/267
3,530,675 A * 9/1970 Turzillo ..... 61/35
3,684,041 A 8/1972 Kammerei, Jr. et al. .... 175/267
3,692,041 A 9/1972 Bondi ..... 137/238
3,757,876 A 9/1973 Pereau ..... 175/267
3,757,877 A * 9/1973 Leathers ..... 175/269
3,800,830 A 4/1974 Etter ..... 137/625.41
3,809,519 A 5/1974 Garner ..... 425/245
3,828,867 A 8/1974 Elwood ..... 175/45
3,874,413 A 4/1975 Valdez ..... 137/625.47
3,902,322 A 9/1975 Watanabe ..... 61/35
3,934,649 A 1/1976 Pasini, III et al. ..... 166/254
3,957,082 A 5/1976 Fuson et al. ..... 137/625.41
3,961,824 A 6/1976 Van Eck et al. ..... 299/17
4,037,658 A 7/1977 Anderson ..... 166/272
4,073,351 A 2/1978 Baum ..... 175/14
4,089,374 A 5/1978 Terry ..... 166/259
4,116,012 A 9/1978 Abe et al. ..... 405/238
4,156,437 A 5/1979 Chivens et al. ..... 137/554
4,169,510 A 10/1979 Meigs ..... 175/65
4,189,184 A 2/1980 Green ..... 299/8
4,220,203 A 9/1980 Steeman ..... 166/271
4,221,433 A 9/1980 Jacoby ..... 299/4
4,257,650 A 3/1981 Allen ..... 299/2
4,278,137 A 7/1981 Van Eek, deceased ..... 175/267
4,296,785 A 10/1981 Vitello et al. ..... 141/105
4,299,295 A 11/1981 Gossard ..... 175/45
4,312,377 A 1/1982 Knecht ..... 137/625.19
4,317,492 A 3/1982 Summers et al. ..... 175/79
4,366,988 A 1/1983 Bodinc ..... 299/14
4,372,398 A 2/1983 Kuckers ..... 175/45
4,390,067 A 6/1983 Willman ..... 166/245
4,396,076 A 8/1983 Inoue ..... 175/265
4,397,360 A 8/1983 Schmidt ..... 175/61
4,401,171 A 8/1983 Fuchs ..... 175/267
4,407,376 A 10/1983 Inoue ..... 175/267
4,442,896 A 4/1984 Reale et al. ..... 166/278
4,494,616 A 1/1985 McKee ..... 175/67
4,512,422 A 4/1985 Knisley ..... 175/99
4,527,639 A 7/1985 Dickinson, III et al. ..... 175/61
4,532,986 A 8/1985 Mims et al. ..... 166/50
4,544,037 A 10/1985 Terry ..... 166/369
4,558,744 A 12/1985 Gibb ..... 166/335
4,565,252 A 1/1986 Campbell et al. ..... 175/269
4,600,061 A 7/1986 Richards ..... 175/62
4,605,076 A 8/1986 Goodhart ..... 175/61
4,611,855 A 9/1986 Richards ..... 299/2
4,618,009 A 10/1986 Carter et al. ..... 175/267
4,638,949 A 1/1987 Mancel ..... 239/307
4,674,579 A 6/1987 Geller et al. ..... 175/45
4,702,314 A 10/1987 Huang et al. ..... 166/245
4,715,440 A 12/1987 Boxell et al. ..... 166/100
4,763,734 A 8/1988 Dickinson et al. ..... 175/62
4,830,105 A 5/1989 Petermann ..... 166/241
4,842,081 A 6/1989 Parant ..... 175/23
4,852,666 A 8/1989 Brunet et al. ..... 175/61
4,978,172 A 12/1990 Schwoebel et al. ..... 299/12
4,981,367 A * 1/1991 Brazelton ..... 366/308
5,016,710 A 5/1991 Renard et al. ..... 166/245
5,035,605 A 7/1991 Dinerman et al. ..... 425/564
5,036,921 A 8/1991 Pittard et al. ..... 166/298
5,074,360 A 12/1991 Guinn ..... 166/281
5,074,365 A 12/1991 Kuckes ..... 175/40
5,074,366 A 12/1991 Karlsson et al. ..... 175/76
5,111,893 A 5/1992 Kvello-Aune ..... 175/258
5,135,058 A 8/1992 Millgard et al. ..... 175/71
5,148,875 A 9/1992 Karlsson et al. ..... 175/62
5,168,942 A 12/1992 Wydrinski ..... 175/50
5,174,374 A 12/1992 Hailey ..... 166/55.8
5,197,553 A 3/1993 Lenumo ..... 175/57
5,197,783 A 3/1993 Theimer et al. ..... 299/17
5,199,496 A 4/1993 Redus et al. ..... 166/366
5,201,817 A 4/1993 Hailey ..... 175/269
5,217,076 A 6/1993 Masek ..... 166/303
5,240,350 A 8/1993 Yamaguchi et al. ..... 405/143
5,242,017 A 9/1993 Hailey ..... 166/55.8
5,246,273 A 9/1993 Rosar ..... 299/4
5,255,741 A 10/1993 Alexander ..... 166/278
5,271,472 A 12/1993 Leturno ..... 175/107
5,301,760 A 4/1994 Graham ..... 175/61
5,363,927 A 11/1994 Frank ..... 175/67
5,385,205 A 1/1995 Hailey ..... 166/55.8
5,402,851 A 4/1995 Baiton ..... 166/369
5,411,085 A 5/1995 Moore et al. ..... 166/242
5,411,104 A 5/1995 Stanley ..... 175/65
5,450,902 A 9/1995 Matthews ..... 166/268
5,454,419 A 10/1995 Vloedman ..... 166/277
5,462,116 A 10/1995 Carroll ..... 166/249
5,469,155 A 11/1995 Archambeault et al. . 340/853.4
5,485,089 A 1/1996 Kuckes ..... 324/346
5,494,121 A 2/1996 Nackerud ..... 175/263
5,501,273 A 3/1996 Puri ..... 166/252.5
5,501,279 A 3/1996 Garg et al. ..... 166/372
5,584,605 A 12/1996 Beard et al. ..... 405/128
5,613,425 A * 3/1997 Krznaric ..... 99/348
5,615,739 A 4/1997 Dallas ..... 166/306
5,659,347 A 8/1997 Taylor ..... 347/85
5,669,444 A 9/1997 Riese et al. ..... 166/263
5,690,390 A 11/1997 Bithell ..... 299/4
5,706,871 A 1/1998 Andersson et al. ..... 141/59
5,720,356 A 2/1998 Gardes ..... 175/62
5,785,133 A 7/1998 Murray et al. ..... 175/61
5,832,958 A 11/1998 Cheng ..... 137/625.41
5,853,054 A 12/1998 McGarian et al. ..... 175/267
5,868,202 A 2/1999 Hsu ..... 166/256
5,868,210 A 2/1999 Johnson et al. ..... 175/40
5,879,057 A 3/1999 Schwoebel, et al. ..... 299/17
5,917,325 A 6/1999 Smith ..... 324/326
5,934,390 A 8/1999 Uthe ..... 175/67
5,957,539 A 9/1999 Durup et al. ..... 299/4
6,024,171 A 2/2000 Montgomery et al. ..... 166/308

* cited by examiner

CAVITY POSITIONING TOOL AND METHOD

TECHNICAL FIELD OF INVENTION

This invention relates generally to the field of downhole cavity tools and more particularly to a cavity positioning tool and method.

BACKGROUND OF THE INVENTION

Subsurface resources such as oil, gas, and water are typically recovered by drilling a bore hole from the surface to a subterranean reservoir or zone that contains the resources. The bore hole allows oil, gas, and water to flow to the surface under its own pressure. For low pressure or depleted zones, rod pumps are often used to lift the fluids to the surface.

To facilitate drilling and production operations, cavities are often formed in the production zone. The cavity allows the well bore to be more readily intersected during drilling operations and collects fluids during production operations. The collection of fluids allows pumps to be operated intermittently when the cavity is full, which reduces wear on the pump.

Short extensions called a "rat hole" are often formed at the bottom of the cavity to collect cuttings and other drilling debris. As the subsurface liquids collect in the well bore, the heavier debris falls to the bottom of the rat hole and is thereby both centralized and collected out of the cavity. To avoid being clogged with debris, inlets for rod and other downhole pumps should be positioned within the cavity above the rat hole. In addition, the pump inlet should be positioned fairly low in the cavity to avoid vapor lock (i.e., below the fluid waterline). Traditional methods of positioning the pump inlets, however, are often inaccurate and inefficient, leading to clogging or vapor lock and increased maintenance and operation costs for the well.

SUMMARY OF THE INVENTION

In accordance with the teachings of the present invention, a cavity positioning tool and method are provided that substantially eliminate and reduce disadvantages and problems with prior systems and methods. In particular, a cavity positioning tool efficiently and accurately positions pump inlets and other downhole devices within or relative to a cavity.

In accordance with one embodiment of the present invention, a cavity positioning tool is provided that includes a head piece adapted to receive a downhole string having a longitudinal axis. A plurality of blunt arms are coupled to the head piece. In operation, the arms are operable to be radially extended outward from a first position of substantial alignment with the longitudinal axis to a second extended position.

More specifically, in accordance with a particular embodiment of the present invention, the arms are pivotally connected to the head piece. In this and other embodiments, the arms extend in response to rotation of the tool. In the absence of rotation, the arms automatically retract by force of gravity.

In accordance with another aspect of the present invention, a device is positioned relative to a subsurface cavity by coupling the device to a plurality of blunt arms. The blunt arms are lowered in a substantially retracted position into the subsurface cavity through a restricted passageway. In the cavity, the blunt arms are radially extended outward from the retracted position to an extended position. The blunt arms are then rested on the floor of the cavity, in the extended position.

In accordance with still another aspect of the present invention, a method is provided for degasifying a coal seam by lowering an inlet of a pump through a well bore into a cavity formed in a coal seam. The cavity extends radially from the well bore. A plurality of arms are coupled to the pump inlet. When the pump inlet is disposed within the cavity, the arms are radially extended. The pump inlet is then lowered until the arms rest on a floor of the cavity, such that the inlet is in a lower part of the cavity and above a rat hole extending below the cavity. Fluids are collected in the cavity and removed with the pump. Gas is recovered through the well bore.

In accordance with yet another aspect of the present invention, a method is provided for degasifying a coal seam by lowering an inlet of a pump through a well bore into a cavity formed in a coal seam. The cavity extends radially from the well bore. A plurality of arms are coupled to the pump inlet. When the pump inlet is disposed within the cavity, the arms are radially extended. The pump inlet is then lowered until the arms rest on a floor of the cavity, such that the inlet is in a lower part of the cavity and above a rat hole extending below the cavity. The pump inlet and arms are rotated, while the pump inlets maintain the same relative position within the cavity. Fluids are collected in the cavity and removed with the pump. Gas is recovered through the well bore.

Important technical advantages of the invention include providing an improved cavity positioning tool and method. In particular, the tool includes arms that are retractable for lowering through a well bore to a cavity and extendable in the cavity to position a device within or at a set relation to the cavity. In one embodiment, the arms are extended by centrifugal force and automatically retract in the absence of centrifugal force. As a result, the tool has a minimum of parts and is highly durable.

Another technical advantage of the present invention includes providing a method and system for positioning a pump inlet in a cavity. In particular, the pump inlet is positioned in a lower portion of the cavity by extending arms that rest on the cavity floor above a rat hole. This position of the pump inlet significantly reduces clogging of the pump inlets and prevents the pump from inadvertently entering the rat hole. Additionally, this position minimizes vapor lock.

Still another technical advantage of the present invention includes providing an improved method for supporting a pump string extended from the surface to a subterranean zone. In particular, a pump string is supported from the floor of the cavity. This allows well head maintenance and other surface operations to be performed without pulling out or otherwise supporting the string from the surface.

Still another technical advantage of the present invention includes providing an improved method for removing solid-laden fluids from a coal seam or other subterranean zone. In particular, a pump inlet is coupled to a cavity positioning device with extending arms that rest on a cavity floor above a rat hole. The arms are rotated slowly to agitate the liquid in the cavity, thereby suspending debris to allow removal within the liquid and lowering the tendency of particulate matter to coalesce. Thus, the debris and particulate matter is less likely to form clumps of larger particles, which reduces clogging of the pump inlets.

Other advantages are readily apparent to one skilled in the art from the following figures, descriptions, and claims.

BRIEF DESCRIPTION OF THE DRAWINGS

For a more complete understanding of the present invention and its advantages, reference is now made to the following description, taken in conjunction with the accompanying drawings, in which.

DETAILED DESCRIPTION OF THE INVENTION

Figure 1A:
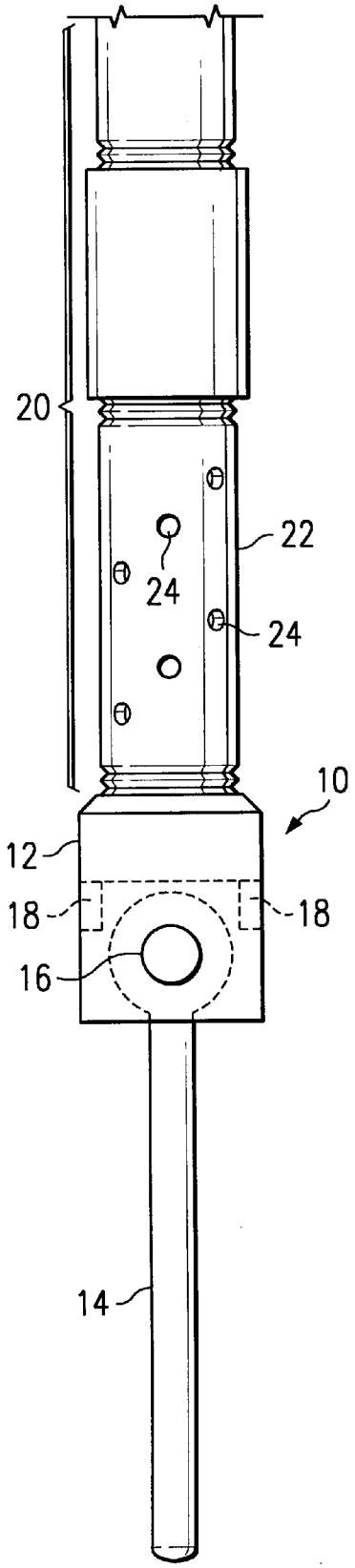
FIGS. 1A–B are diagrams illustrating side views of a cavity positioning tool in accordance with one embodiment of the present invention.
Figure 1B:
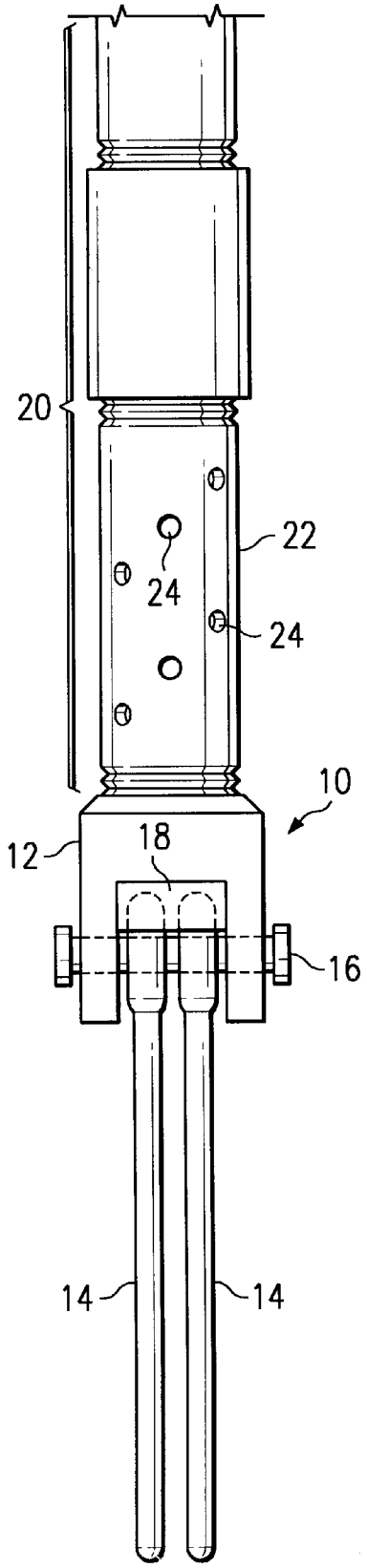

FIGS. 1A–B illustrate a cavity positioning tool 10 in accordance with one embodiment of the present invention. In this embodiment, tool 10 is adapted to position a pump inlet in a subsurface cavity. It will be understood that tool 10 may be adapted to position other suitable devices within or in relation to a cavity. For example, motors, controllers, and valves may be positioned in or relative to a cavity with the tool 10. Tool 10 is constructed of steel or other suitable metals or materials, such that are resistant to damage in the downhole environment.

Referring to FIG. 1A, the tool 10 comprises a head piece 12 and a plurality of blunt arms 14. As described in more detail below, the arms are coupled to the head piece 12 and operable to be radially extended outward from a first position of substantial alignment with a longitudinal axis associated with the head piece 12 to a second extended position. In the illustrated embodiment, the blunt arms 14 are coupled to head piece 12 by pivot assembly 16. It will be understood that blunt arms 14 may by slidably or otherwise suitably coupled to head piece 12.

The head piece 12 is configured at one end to receive a downhole string 20. Head piece 12 may be threaded to receive a downhole string, or may include clamps, interlocking pieces, or be otherwise suitably configured to attach to, engage, or mate with downhole string 20. Head piece 12 may be an integrated piece or a combination of components. For example, head piece 12 may include a downhole motor for rotating the head piece 12, such as a bottom part of the head piece 12, relative to the downhole string.

The downhole string 20 is a drill string, pump string, pipe, wireline, or other suitable downhole device that can be used to dispose the tool 10 within a cavity and extend the blunt arms 14. In the illustrated embodiment, the downhole string 20 is a pump string 22 with an inlet 24 coupled directly to the tool 10. The pump string 22 may be a sucker or other rod or multistage pump, a downhole pump with piping to the surface, or other suitable pumping system.

The blunt arms 14 are rounded, dull, or otherwise shaped so as to prevent substantial cutting of or damage to the cavity. In the illustrated embodiment, blunt arms 14 are cylindrical in shape with an elongated body and having a circular cross-section.

The blunt arms 14 may be end-weighted by adding weight to the ends distal to the head piece 12, or may comprise a hollow portion proximate to the head pin such that the ends of the blunt arms 14 are thereby made heavier than the rest of the blunt arms 14. The blunt arms 14 are sized to fit within a cavity when in an extended position and to exceed a diameter of a rat hole, bore hole, or other extensions, if any, below the cavity.

The pivot assembly 16 rotatably connects the blunt arms 14 to the head piece 12. In one embodiment, the pivot assembly 16 allows the blunt arms 14 to radially extend and retract in response to rotational energy applied to the tool 10. In this embodiment, pivot assembly 16 may be a clovis-and-pin type assembly.

As illustrated, blunt arms 14 hang freely down, in substantial alignment with the longitudinal axis of head piece 12. Blunt arms 14 are in substantial alignment when the blunt arms 14 hang freely down, within a few degrees of the longitudinal axis and/or fit down and through a well bore. As described in more detail below, in response to rotation of head piece 12, blunt arms 14 are radially extended towards a perpendicular position relative to head piece 12. The blunt arms 14 are automatically retracted when head piece 12 ceases to rotate by force of gravity or other suitable mechanism. It will be understood that the blunt arms 14 may be slidably or otherwise suitably connected to the head piece 12.

The pivot assembly 16 may include stops 18 to control extension of blunt arms 14. Stops 18 may be configured to allow blunt arms 14 to extend ninety degrees to a perpendicular position, may limit the extension of blunt arms 14 to a lesser range, or permit a range greater than ninety degrees. Stops 18 may be integral or adjustable. Controlling the stops 18, and the extension of blunt arms 14 thereby, controls the resting place of the pump string 22 relative to the floor of the cavity.

Figure 2A:
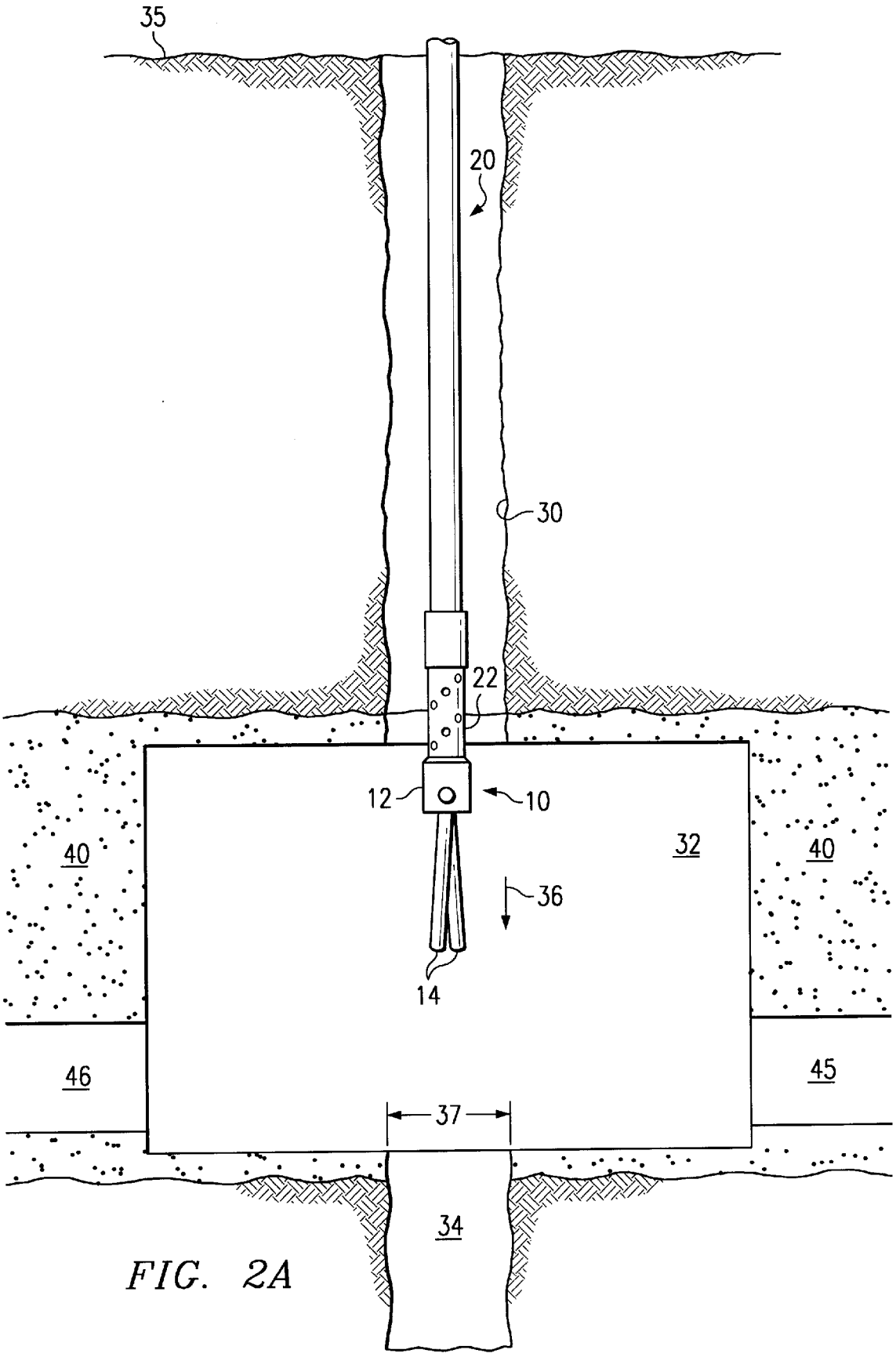
FIGS. 2A–C are a series of diagrams illustrating operation of the tool of FIG. 1 in accordance with one embodiment of the present invention; and, FIGS. 3A–B are a series of diagrams illustrating operation of the tool of FIG. 1, in accordance with another embodiment of the present invention.
Figure 2B:
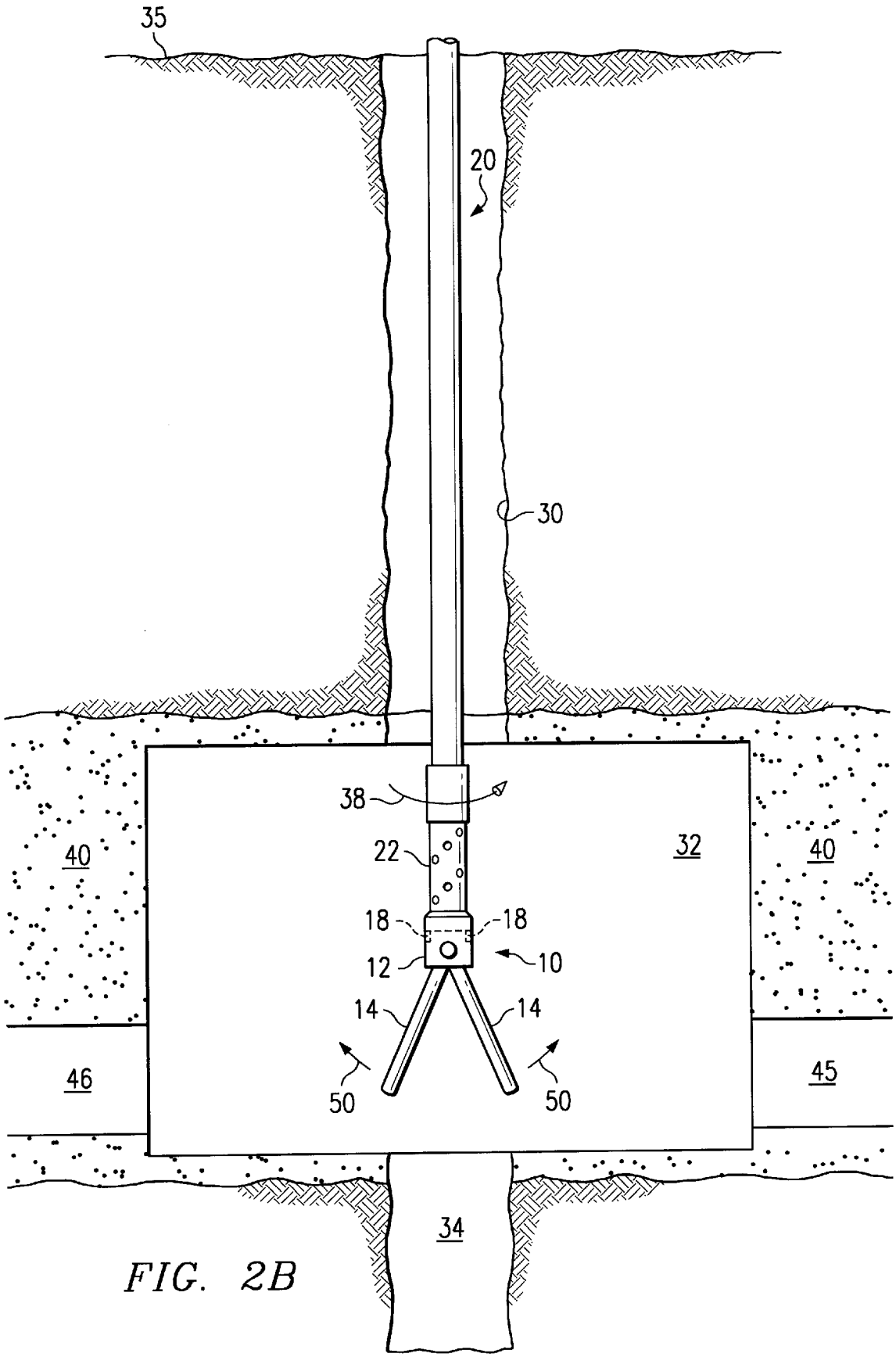
Figure 2C:
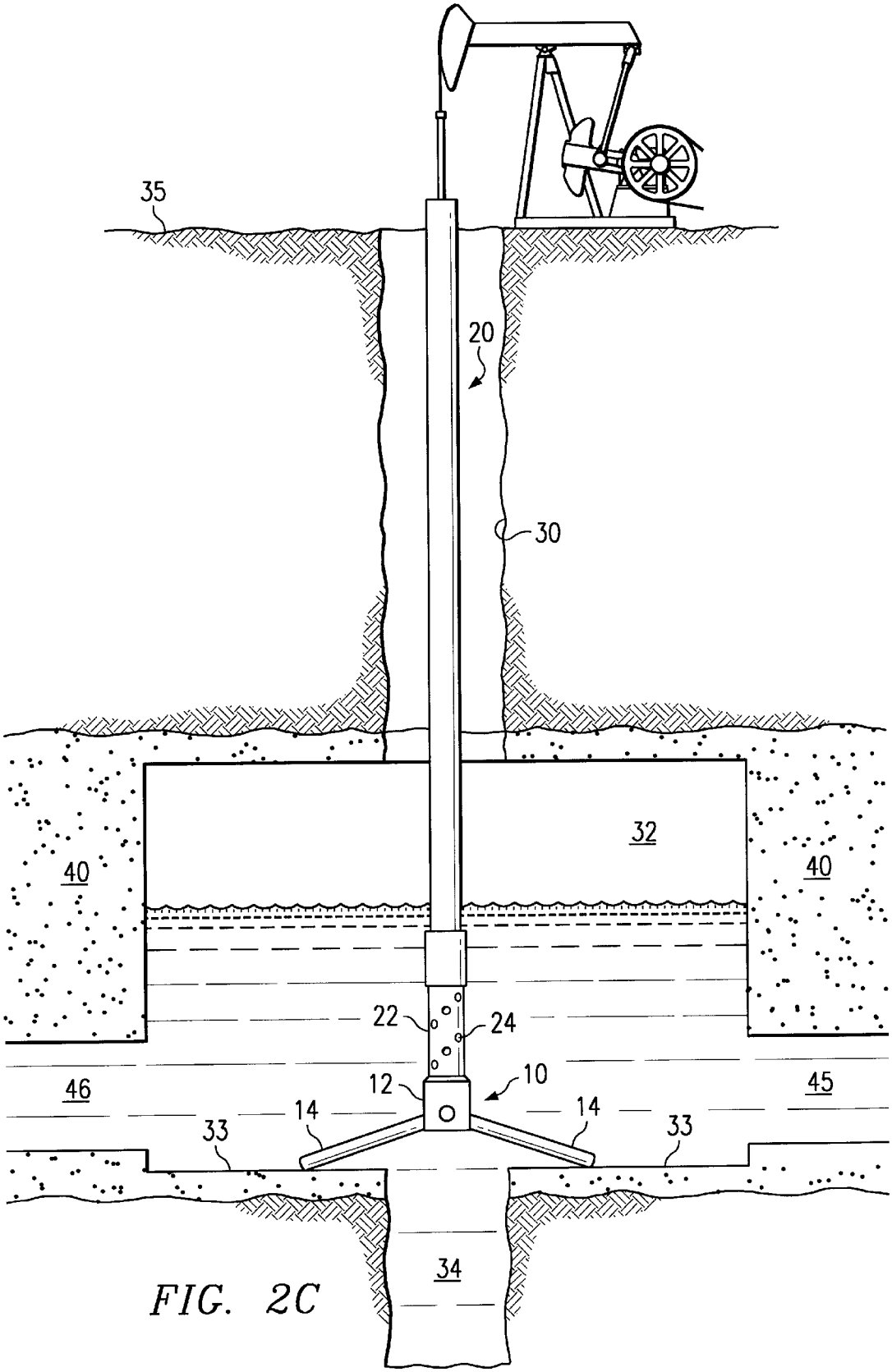

FIGS. 2A–C are a series of drawings illustrating the operation of tool 10. Referring to FIG. 2A, a pump string is positioned in a cavity for a degasification operation in connection with a coal seam prior to mining operations. In this embodiment, a well bore 30 is drilled from the surface 35 into a coal seam 40. A cavity 32 is formed within the coal seam 40. A rat hole 34 is drilled at the bottom of cavity 32. The rat hole 34 has a diameter 37. In a preferred embodiment, the blunt arms 14 have a length such that when extended, the distance from the distal end of one blunt arm 14 to the distal end of another blunt arm 14 exceeds the diameter 37. It will be noted that in this instance, as well as throughout this description, use of the word "each" includes all of any particular subset. A drainage pattern 45 is drilled from a radiused bore 46 and extends into the coal seam 40 and connects to cavity 32. The well bore 30 may have a diameter between seven and ten inches, the cavity a diameter between seven and nine feet, and the rat hole a diameter between seven and ten inches. Further information regarding the dual wells and drainage pattern is described in co-owned U.S. patent application Ser. No. 09/444,029, entitled "Method and System for Accessing Subterranean Deposits from the Surface," which is hereby incorporated by reference.

The pump string 20 is positioned by coupling an inlet to the coupling means 12 of the positioning tool 10. Next, the tool 10 on the pump string 20 is lowered through the well bore 30. While tool 10 is lowered through well bore 30, the blunt arms 14 remain in the retracted position with the blunt arms 14 hanging down in substantial alignment with the longitudinal axis of pump string 20. Blunt arms 14 are lowered until proximate to the cavity 32. Estimating the position of the cavity may be accomplished by comparing the known approximate depth of the cavity 32 to the length of pump string 20 in hand or deployed, or other suitable methods.

Referring to FIG. 2B, after the tool is positioned proximate to the cavity 32, blunt arms 14 are extended by rotating the head piece 12. In the illustrated embodiment, head piece 12, is rotated by rotating the pump string 20, for example, in the direction of arrow 38. As pump string 20 is rotated, the blunt arms 14 are extended radially outward from pump string 20 in opposite directions, traveling generally as indicated by arrow 50. One skilled in the art will recognize that other methods are available to extend blunt arms 14 radially outward from pump string 20. For example, mechanical means such as a wire connected to blunt arms 14 might be used to extend blunt arms 14 radially outward from pump string 20. The blunt arms 14 are extended until they contact the stops 18.

Referring to FIG. 2C, once the blunt arms 14 are extended, or while being extended, the pump string 20 is lowered further into well bore 30. Pump string 20 is lowered until blunt arms 14 make contact with the floor 33 of cavity 32. When resting on the cavity floor 33, pump inlets 24 are at a known position within the cavity 32. By adjusting the spacing between the pump inlets 24 and the blunt arms 14 of the tool 10, the distance between the pump inlets 24 and the cavity floor 33 can be modified. This adjustment may be made in a variety of ways, including adding spacers to the head piece 12. Additionally, by changing the maximum angle of the blunt arms 14, the distance between the pump inlets 24 and the cavity floor 33 can be modified. Adjusting the maximum angle of the blunt arms 14 can be accomplished in a variety of ways, including adjusting the stops 18 to restrict the radial extension of the blunt arms 14. Therefore, the present invention provides for more definite location of the pump inlets 24 within cavity 32, by use of positioning tool 10.

Once the pump 22 is positioned within cavity 32 by tool 10, fluids that drain from the drainage pattern 45 into the cavity 32 are pumped to the surface with the pump string 20. Fluids may be continuously or intermittently pumped as needed to remove the fluids from the cavity 32. Additionally, gas is diffused from the coal seam 40 and is continuously connected at the surface 35 as it passes through well bore 30.

When fluid and gas removal operations are complete, the tool 10 may be removed from its position within cavity 32. In reverse operation, pump string 20 is raised until blunt arms 14 are no longer in contact with the floor 33 of cavity 32. Blunt arms 14 are moved from an extended position to one of substantial alignment with pump string 20. If the blunt arms 14 were extended by centrifugal force, the blunt arms 14 will return to the first position of substantial alignment with pump string 20 upon being raised from the cavity floor. Once the blunt arms 14 have been returned to a position of substantial alignment with pump string 20, pump string 20 may be raised through and out of well bore 30.

Figure 3A:
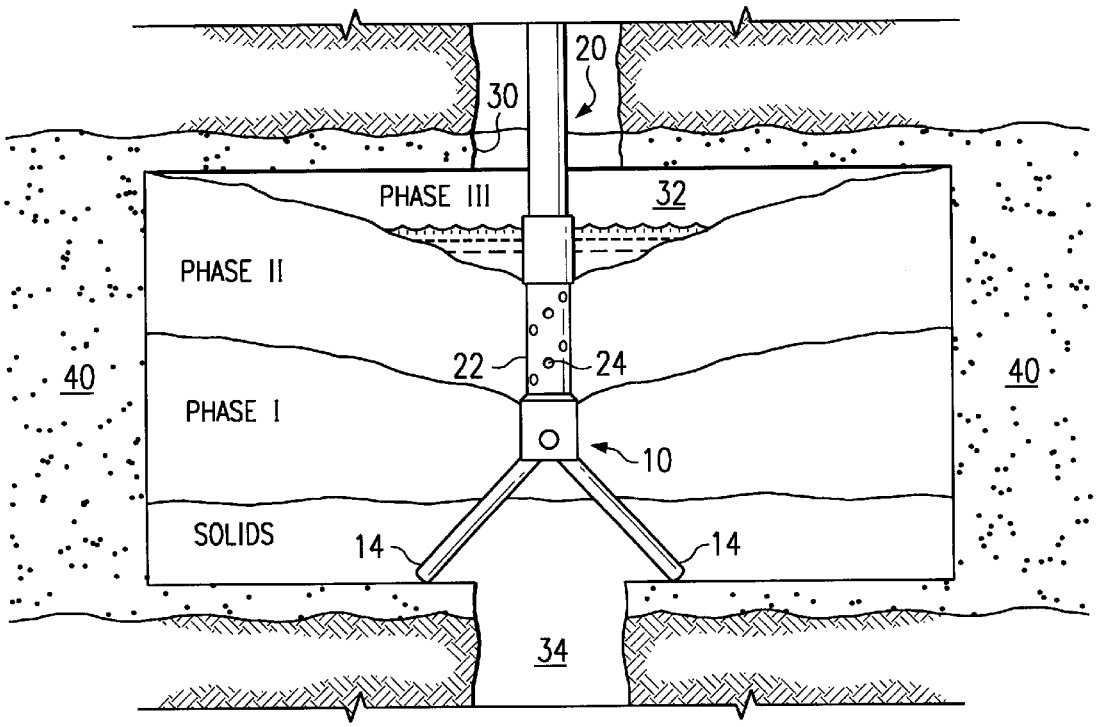
Figure 3B:
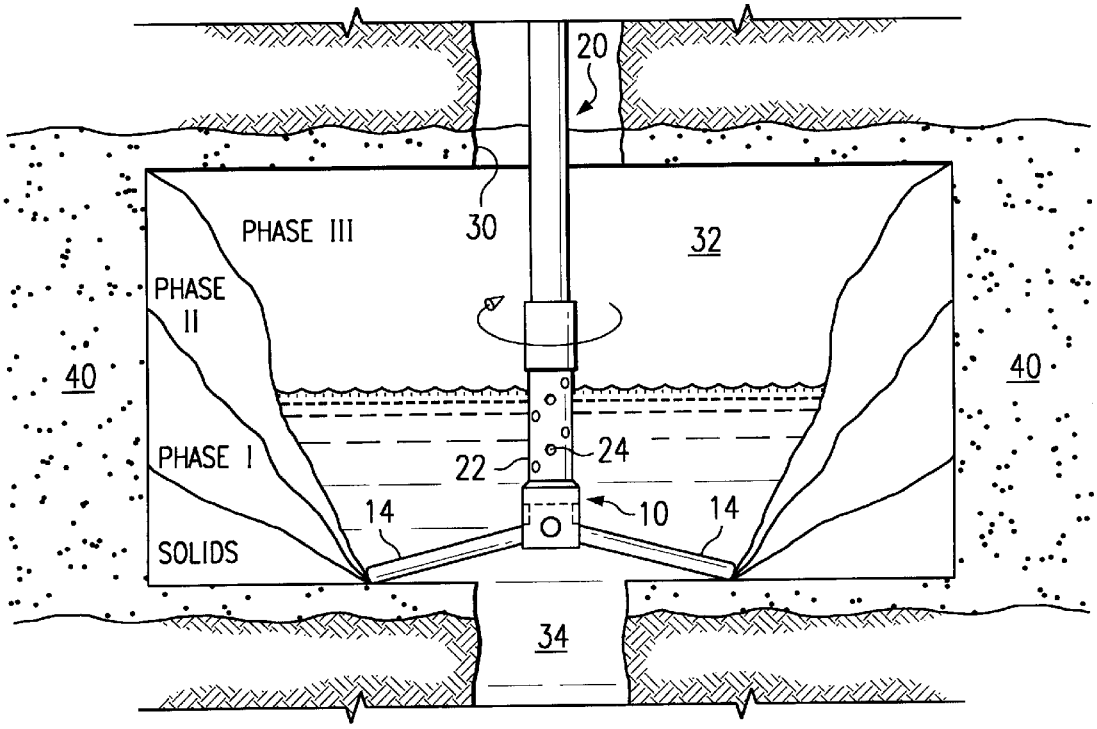

FIGS. 3A–B are a series of drawings illustrating operation of tool 10 during production of fluid and gas from the cavity 32. Referring to FIG. 3A, the pump string 20 is positioned in the cavity 32 for degasification operation of the coal seam 40 as previously described. The pump inlets 24 are positioned within the cavity 32 such that the pump inlets 24 are above rat hole 34, but below the waterline of the fluids collected in cavity 32.

As fluids are collected in the cavity 32, particulate matter and other debris such as drilling cuttings and coal fines are also collected in the cavity 32. Operation of the downhole pump 22 causes the suspended particulate matter and other debris to move through different locations within the body of fluid in cavity 32. As the settling of particulate matter and other debris proceeds, the amount of particulate matter and other debris suspended in the fluid changes. Accordingly, different locations within the fluid body, or phases, have different concentrations of particulate matter and other debris. The heavier debris settles to the floor of cavity 32 and may eventually settle in rat hole 34.

The relative size of the particulate matter and other debris changes across the different phases of the fluid body. The smallest particulate matter and other debris remains close to the surface in Phase III, as shown in FIG. 3A. As the particulate matter and other debris coalesces or clumps together, the composite matter begins to settle through the phases and may eventually fill the rat hole 34 and form a solid layer of sludge on the floor of cavity 32. Eventually, the depth of the sludge layer and size of the composite matter is such that the pump inlets 24 become clogged, causing production delays and added expense.

Referring to FIG. 3B, the blunt arms 14 are rotated in the cavity 32 about the longitudinal axis of pump string 20 by rotating the pump string 20 at the surface or by other suitable means. In one embodiment, the pump string is rotated at the surface by a tubing rotator, at approximately one rotation per day.

Rotating the blunt arms 14 agitates the fluid collected within the cavity 32. In the absence of agitation the particulate matter and other debris may coalesce or clump together forming larger composite matter that would eventually clog the pump inlets 24. With rotation of the blunt arms 14, however, solids remain suspended in the fluid and are removed with the fluid. In addition, the distribution of the remaining particulate matter is pushed away from the pump inlets 24, towards the sidewalls of cavity 32.

As illustrated in FIG. 3B, rotation of the blunt arms 14 causes the levels or phases decrease in area. Furthermore, rotation causes the shape of the phases to become more sharply sloping from the sidewalls of cavity 32 towards the floor of cavity 32. The change in shape of the phases prevents particulate matter from clumping in the liquid in the near vicinity of the pump inlets 24. Thus, rotation of the blunt arms 14 decreases the concentration of large particulate matter and other debris surrounding the pump inlets 24, and thereby greatly reduces clogging of the pump inlets 24, and the increased costs associated therewith.

Although the present invention has been described in detail, it should be understood that various changes, alterations, substitutions, and modifications may be made to the teachings herein without departing from the spirit and scope of the present invention, which is solely defined by the appended claims.

What is claimed is:

1. A cavity positioning tool comprising:

a head piece configured to receive a downhole string having a longitudinal axis;

a plurality of blunt arms coupled to the head piece, the blunt arms configured to contact a surface of the cavity to position the tool in the cavity without substantial cutting of the surface of the cavity; and the arms operable to be radially extended outward from a first position of substantial alignment with the longitudinal axis to a second extended position.

2. The cavity positioning tool of claim 1, wherein the blunt arms each comprise a rounded end distal from the head piece.

3. The cavity positioning tool of claim 1, wherein the blunt arms each comprise at least one rounded side.

4. The cavity positioning tool of claim 1, wherein each blunt arm comprises a rounded periphery.

5. The cavity positioning tool of claim 1, wherein the blunt arms are pivotally connected to the head piece.

6. The cavity positioning tool of claim 1, wherein the blunt arms are pivotally connected to the head piece by a pin.

7. The cavity positioning tool of claim 1, wherein the blunt arms are operable to extend to the second extended position in response to rotation of the head piece.

8. The cavity positioning tool of claim 1, wherein the head piece comprises:

a clevis sized to receive a first end of each blunt arm; and a pin pivotally connecting the first end of the blunt arms to the clevis.

9. The cavity positioning tool of claim 1, wherein the head piece is configured to receive a pump string.

10. The cavity positioning tool of claim 1, wherein the head piece is configured to receive a pump inlet of a pump string.

11. The cavity positioning tool of claim 1, further comprising stops for each blunt arm, the stops operable to limit the outward extension of the blunt arm from the first position.

12. The cavity positioning tool of claim 11, wherein the stops are operable to limit the outward extension of the blunt arm from the first position to a position substantially perpendicular to the head piece.

13. The cavity positioning tool of claim 1, wherein the blunt arms are operable to be rotated around the longitudinal axis.

14. A method for positioning a downhole device relative to a subsurface cavity comprising:

coupling the device to a plurality of blunt arms, the blunt arms configured to contact a surface of the cavity to position the tool in the cavity without substantial cutting of the surface of the cavity;

lowering the blunt arms to the cavity through a restricted passageway with the blunt arms in a substantially retracted position;

radially extending the blunt arms outward from the retracted position to an extended position within the cavity; and resting the blunt arms in the extended position on a floor of the cavity.

15. The method of claim 14, wherein the blunt arms are pivotally extended.

16. The method of claim 14, wherein the blunt arms are radially extended by centrifugal force.

17. The method of claim 14, wherein the blunt arms are extended to a position substantially perpendicular to the head piece.

18. The method of claim 14, wherein the device comprises an inlet for a pump string.

19. The method of claim 14, further comprising slowly rotating the blunt arms about a longitudinal axis while the blunt arms are in the extended position.

20. The method of claim 19, wherein the blunt arms are rotated at the rate of 10 revolutions per day, or less.

21. The method of claim 19, wherein the blunt arms are rotated at the rate of 5 revolutions per day, or less.

22. The method of claim 19, wherein the blunt arms are rotated at the rate of 1 revolution per day, or less.

23. A method for positioning a pump inlet in a cavity for removing fluids from a subsurface formation, comprising:

lowering an inlet of a pump through a well bore into a cavity, the cavity extending radially from the well bore;

radially extending within the cavity a plurality of blunt arms coupled to the pump inlet, the blunt arms configured to contact a surface of the cavity to position the tool in the cavity without substantial cutting of the surface of the cavity; and resting the arms on a floor of the cavity.

24. The method of claim 23, wherein the pump is a suction-rod pump.

25. The method of claim 23, wherein the pump is a downhole pump.

26. The method of claim 23, further comprising slowly rotating the blunt arms about a longitudinal axis while the blunt arms are in the extended position.

27. The method of claim 26, wherein the blunt arms are rotated at the rate of 10 revolutions per day, or less.

28. The method of claim 26, wherein the blunt arms are rotated at the rate of 5 revolutions per day, or less.

29. The method of claim 26, wherein the blunt arms are rotated at the rate of 1 revolution per day, or less.

30. A method for degasifying a coal seam, comprising:

lowering an inlet of a pump through a well bore into a cavity formed in a coal seam, with a rat hole below the cavity, the cavity extending radially from the well bore;

radially extending within the cavity a plurality of blunt arms coupled to the pump inlet;

positioning the inlet in a lower part of the cavity above the rat hole by resting the blunt arms on a floor of the cavity;

collecting fluids in the cavity;

removing the fluids with the pump; and recovering gas through the well bore.

31. The method of claim 30, further comprising slowly rotating the blunt arms about a longitudinal axis while the blunt arms are in the extended position.

32. The method of claim 31, wherein the blunt arms are rotated at the rate of 10 revolutions per day, or less.

33. The method of claim 31, wherein the blunt arms are rotated at the rate of 5 revolutions per day, or less.

34. The method of claim 31, wherein the blunt arms are rotated at the rate of 1 revolution per day, or less.

35. A method for removing particulate laden fluid from a subterranean zone, comprising:

lowering an inlet of a pump through a well bore into a cavity formed in a subterranean zone, the cavity extending radially from the well bore;

radially extending within the cavity a plurality of blunt arms coupled to the pump inlet, the blunt arms configured to contact a surface of the cavity to position the tool in the cavity without substantial cutting of the surface of the cavity;

positioning the inlet in the cavity by resting the blunt arms on a floor of the cavity;

collecting particulate laden fluids in the cavity;

agitating the fluid by rotating the blunt arms about a longitudinal axis of the pump; and, removing the fluids with the pump.

36. The method of claim 35, wherein the blunt arms are rotated at the rate of 10 revolutions per day, or less.

37. The method of claim 35, wherein the blunt arms are rotated at the rate of 5 revolutions per day, or less.

38. The method of claim 35, wherein the blunt arms are rotated at the rate of 1 revolution per day, or less.

* * * * *

UNITED STATES PATENT AND TRADEMARK OFFICE

CERTIFICATE OF CORRECTION

PATENT NO. : 6,412,556 B1 
DATED : July 2, 2002
INVENTOR(S) : Joseph A. Zupanick It is certified that error appears in the above-identified patent and that said Letters Patent is hereby corrected as shown below:

Title page,
Item [73], Assignee, after "CDX Gas," delete "Inc." and insert -- LLC --.

Signed and Sealed this

Fifteenth Day of April, 2003

JAMES E. ROGAN
*Director of the United States Patent and Trademark Office*